US006110053A

United States Patent [19]

Sjöblom

[11] Patent Number: 6,110,053

[45] Date of Patent: Aug. 29, 2000

[54] GOLF CUP INSERT

[75] Inventor: Håkan Sjöblom, Umeå , Sweden

[73] Assignee: H.A.C. Invent AB, Umea, Sweden

[21] Appl. No.: 09/064,424

[22] Filed: Apr. 22, 1998

[51] Int. Cl.[7] ..... A63D 69/36

[52] U.S. Cl. ..... 473/179

[58] Field of Search ..... 473/179, 180

[56] References Cited

U.S. PATENT DOCUMENTS

| | | | |
|---|---|---|---|
| 3,772,841 | 11/1973 | Barak et al. | 473/179 |
| 4,906,006 | 3/1990 | Sigunick | 473/179 |
| 5,078,394 | 1/1992 | Kretz | 473/179 |
| 5,390,917 | 2/1995 | Mendoza | 473/179 |

*Primary Examiner*—Mark S. Graham
*Attorney, Agent, or Firm*—John Lezdey & Assoc

[57] ABSTRACT

The invention relates to a golf cup insert for reducing the size of the hole of a golf cup so that a player is able to putt towards a smaller cup. The cup insert can be inserted into and fixed positionally in the cup so that the upwardly facing end of the insert will present a hole whose diameter is smaller than the diameter of a conventional golf cup and which is located flush with the surface of the ground surrounding the cup. The insert includes a cup insert member whose largest outer diameter is slightly smaller than the internal diameter of the cup and has at its bottom an axially adjustable support which when the insert is inserted into the cup, supports against the bottom thereof and enables the upwardly facing side of the cup to be adjusted to the level of the surface surrounding the golf cup, depending on the depth of the cup. The cup insert member tapers concentrically downwards so that when the cup surrounding surface slopes in relation to the cup axis, the cup insert member can be leaned against part of the cup wall and therewith enable the upwardly facing end of the insert to be brought flush with the surface of the ground surrounding the cup.

7 Claims, 2 Drawing Sheets

GOLF CUP INSERT

FIELD OF THE INVENTION

The present invention relates to an insert for reducing the size of a golf cup, so that a player is able to putt towards a smaller cup for practice purposes for instance, wherein the cup insert can be inserted into and fixed positionally in the cup so that the upwardly facing end of the insert will present a hole whose diameter is smaller than the diameter of a conventional golf cup and which is located flush with the surface of the ground surrounding cup. Putting on golf greens is an important part of a golfer's game and also often difficult to perform satisfactorily. The dimensions of the cup on putting surfaces are precisely determined world-wide. Putting can be practiced in many different ways, normally by putting the ball from varying distances from the cup and on surfaces that have varying undulations. It is known to make practice more effective by using devices which reduce the size of the cup, so that in practice the player will putt towards a cup of smaller diameter than the original hole. This will late, have a positive influence when putting in golf tournaments in which the cups are larger.

BACKGROUND OF THE INVENTION

These devices are normally the form of an annular cover plate having a central opening whose diameter is smaller than a conventional golf cups The cover plate is either made of a resilient material or of a hard material that has a resilient material placed around its periphery and which has an outer diameter that is slightly larger than the diameter of a conventional golf cup. The cover plate can therewith be inserted into the cup and held in position by the friction generated between the periphery of the plate and the wall of the cup. One drawback with this type of device is that it is liable to be moved out of position as a golf ball passes over the plate or will loosen from the cup as a player inserts his/her fingers into the cup to retrieve the ball.

DESCRIPTION OF PRIOR ART

With the intention of eliminating this drawback, there is proposed in U.S. Pat. No. 5,390,917 a device which includes a cup insert member having an annular surface in which there is provided a central opening whose diameter is smaller than the diameter of a conventional golf cup. This device includes a number of spikes which move radially in relation to the annular surface, wherein the device can be inserted into a golf cup and set to the level of the cup surrounding surface when the spikes are retracted, whereafter the spikes are moved radially outwards to fix the insert in position.

One drawback with this type of insert is that it is difficult to fix in position and tat fixation of the insert with the aid of the spikes damages the wall of the cup or hole.

SUMMARY OF THE INVENTION

The object of the intention is to provide for reducing the size of the opening of a cup an insert which is constructed in a manner which enables the insert to be fitted in position in a simple and reliable fashion. Another object of the invention is to provide a golf cup insert with which the size of the cup opening can be readily adjusted and with which balls can be readily retrieved therefrom.

These objects are achieved with the golf cup insert of the current invention.

Because the insert includes a member which can be inserted into a putting cup and which has provided at its bottom supportive means that can be adjusted in the axial direction of said cup insert member and which are intended to support against the bottom of the cup and enable the upwardly facing side of the cup insert member to be brought level with the surface surrounding the cup, depending on the depth of the cup, in combination with the cup insert member also including a concentrically and downwardly narrowing part so that when the cup surrounding surface slopes in relation to the direction of the cup axis the upwardly facing side of the cup insert member can be brought to lie flush with the level of the ground surrounding the cup by virtue of tilting the insert and supporting the same against a cup wall, even when the centre axis of the cup is not normal to the plane of said cup surrounding surface, there is obtained a insert which can be affixed in the golf cup in a simple and stable fashion and whose upper side will always be adjusted in line with the surface surrounding the golf cup.

Thus, the upper part of the cup insert member is configured to receive and accommodate exchangeable annular plates which have holes of mutually different sizes and which enable the size of the cup opening to be readily altered and also enable the balls to be readily retrieved from the insert.

The invention will now be described in more detail with reference to exemplifying embodiment thereof and also with reference to the accompanying drawings.

DESCRIPTION OF THE PREFERRED EMBODIMENTS

Figure 1:
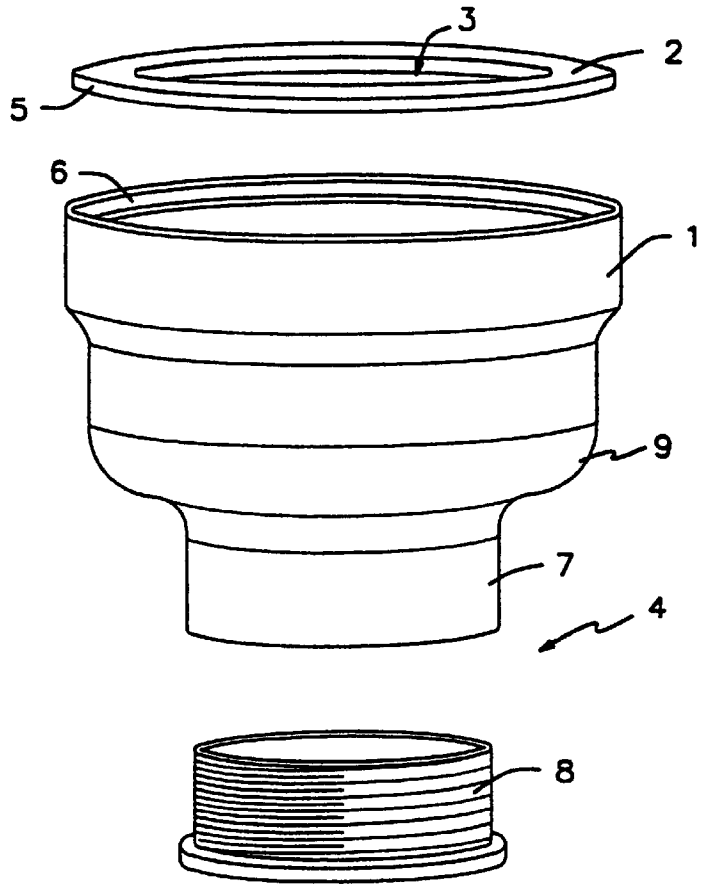
FIG. 1 is an exploded perspective view of an inventive insert.

The insert shown in FIG. 1 includes generally three parts, namely a cylindrical cup insert member 1, a circular plate 2 placed on top of the cup insert and having a central hole 3 through which a golf ball (not shown) will pass, and support means 4 that can be adjusted in the axial direction of the cup insert. To enable cup insert member 1 to accomodate and hold the annular plate 2, the inner surface of said member 1 has a ledge 6 which is adapted to the outer periphery 5 of the plate 2, such as to enable an annular plate to be readily replaced with annular plates of larger or smaller hole diameters, so as to obtain a hole of the desired size. The annular plate 2 can be easily removed from the cup insert member and balls lying on the bottom of the insert can be readily retrieved simply by removing the plate.

The aforesaid axially adjustable support 4 is achieved with the aid of a hollow cylindrical member 7 provided at the bottom of the cup insert member 1 and having threads which coact with an externally threaded sleeve 8 whose position can be adjusted axially by rotating the sleeve.

As illustrated in the drawings, the cup insert member 1 narrows concentrically downwards in steps. However, to provide space for golf balls entering the cup insert member 1, the member has a diameter transition 9 whose internal radius corresponds to part of the peripheral surface of a golf boll.

Figure 2:
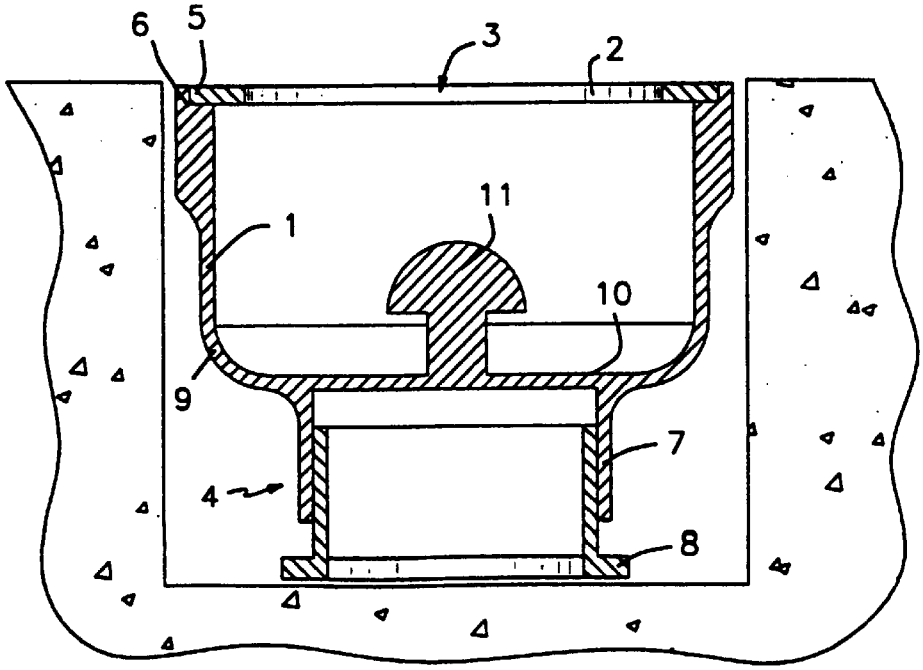
FIG. 2 is a vertical section view of an assembled insert according to FIG. 1 inserted in a golf cup where the cup-surrounding ground surface lies in a plane normal to the centre axis of the cup.
Figure 3:
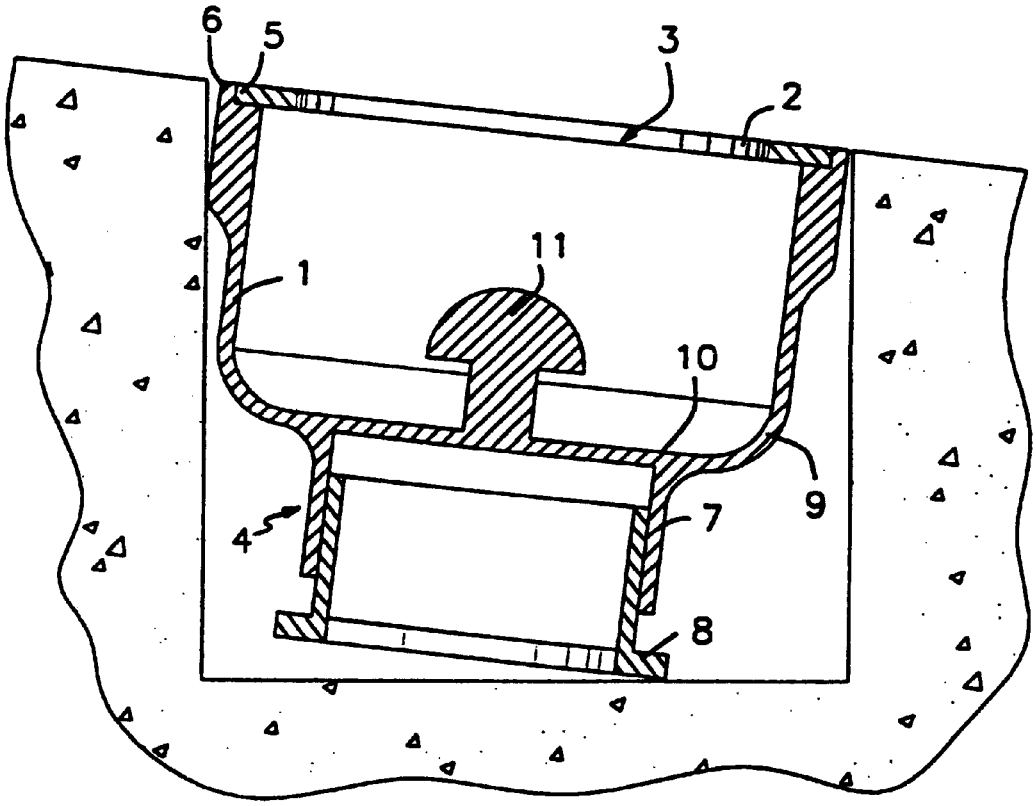
FIG. 3 illustrates the inventive insert inserted into a golf cup where the cup-surrounding ground surface slopes in relation to the cup centre axis and shows the insert inclined to the centre axis of the cup.

The cup insert member may comprise two compression moulded plastic halves which are mutually joined at the vertical section shown in FIGS. 2 and 3. The advantage afforded by forming the cup insert member 1 from two compression moulded halves is that this can be achieved with simple tools and the member can be configured with the internal thread and said shoulder in the moulding process. Furthermore, the annular plate or plates 2 end the sleeve 8 can also be produced from plastic material in a similar manner or in some other suitable way.

As will seen from FIGS. 2 and 3, the cup insert member 1 is provided with a grip 11 by means of which the insert member can be readily removed from the cup. The grip 11 is positioned centrally on the bottom 10 of the cup insert member 1 and has, in cross-section, a mushroom shape so as to enable it to be gripped easily and also so as to guide golf bolls to the edge parts of the bottom 10 of the cup insert member.

FIG. 2 shows the golf cup insert inserted into a cup or hole whose centre axis is normal to the plane of the surface surrounding the cup. In this case, the threaded sleeve 8 is adjusted to a position in which the annular plate 2 placed in the cup insert member 1 is flush with the cup-surrounding ground surface, with the bottom end of the sleeve 8 resting on the bottom of the existing cup or hole.

FIG. 3 illustrates the inventive cup insert inserted into a standard, existing golf cup or hole where the surface of the ground surrounding said cup or hole slopes in relation to its centre axis. In order to bring the annular plate 2 on the cup insert member 1 into line with the surface of the ground surrounding the cup or hole with the end of the sleeve 8 resting on the bottom thereof, the cup insert member is supported with some part thereof in abutment with the wall of the cup or hole and thus inclined relative to the centre axis thereof.

Since the bottoms of golf cups or holes nay have mutually dissimilar configurations, it is necessary that the support means 4 of the inventive cup insert is arranged in a manner which will enable it to be placed in a golf cup or hole in the manner intended irrespective of the configuration of its bottom. For instance, the bottom of a golf cup or hole may be quite flat, slightly conical and slope up towards its centre, or may be provided with a pin in its centre. In order to accommodate this pin, the sleeve 8 of the support means 4 must be hollow.

It will be understood that the invention is not restricted to the described and illustrated embodiment thereof and that modifications can be made within the scope of the following claims.

What is claimed is:

1. A golf cup insert having an upwardly facing end, said insert being adapted to reducing the size of the hole of a golf cup wherein said insert is insertable into and positionally attachable in a cup so that the upwardly facing end of said insert will encompass a hole having a diameter that is smaller than the diameter of a conventional golf cup and which is located flush with the surface of the ground surrounding a cup, said insert comprising a cup insert member having an outer diameter that is slightly smaller than the internal diameter of a cup; said cup insert member further comprising at the bottom thereof an axially adjustable support means, said support means being supported against a bottom of a cup and enabling the upwardly facing side of said cup insert to be adjusted to the level of the surface surrounding the golf cup insert when said insert is inserted into a cup; said cup insert member tapering concentrically downwards so that when a cup surrounding surface slopes in relation to the cup axis said cup insert member is leanable against a cup wall surface.

2. An insert according to claim 1, further comprising an annular plate wherein said cup insert member is configured to receive and support said annular plates said plate encompassing a centrally located hole.

3. An insert according to claim 2, wherein said insert further comprises an inside area having a ledge wherein said annular plate is supported on said ledge.

4. An insert according to claim 1, wherein said support means comprises a hollow cylindrical part formed on the bottom of said cup insert member, said support means further comprising an internal screw thread and an externally threaded sleeve, said thread being engagable with said sleeve wherein the position of said sleeve is rotatable adjustable.

5. An insert according to claim 4, wherein a bottom of a cup has a centrally located pin and wherein said externally threaded sleeve has a pin accommodating hollow.

6. An insert according to claim 1, further comprising edged parts at the bottom of said insert and a grip located in the center of the bottom of said cup insert member, wherein said grip has a mushroom-shaped piece that guides golf balls to said edge parts.

7. The insert according to claim 2, wherein said annular plate is constructable to encompass holes of different sizes.

* * * * *